US007448557B2

(12) United States Patent
Ray et al.

(10) Patent No.: US 7,448,557 B2
(45) Date of Patent: Nov. 11, 2008

(54) APPLICATION AND METHOD TO DISPERSE SUBSTANCE CONTAINED IN A REPLACEABLE CARTRIDGE

(75) Inventors: Gaines Thomas Ray, Doyline, LA (US); Thomas Anderson Agee, Shreveport, LA (US); August Karnell Doner, Chelsea, OK (US); Sig Lane, Shreveport, LA (US); Shawn Michael Stotts, Edmond, OK (US)

(73) Assignee: STT Product Development, Inc., Shreveport, LA (US)

( * ) Notice: Subject to any disclaimer, the term of this patent is extended or adjusted under 35 U.S.C. 154(b) by 83 days.

(21) Appl. No.: 11/581,314

(22) Filed: Oct. 16, 2006

(65) Prior Publication Data

US 2007/0095942 A1 May 3, 2007

Related U.S. Application Data

(62) Division of application No. 10/659,546, filed on Sep. 9, 2003, now abandoned.

(60) Provisional application No. 60/411,485, filed on Sep. 17, 2002.

(51) Int. Cl.
*B05B 7/30* (2006.01)

(52) U.S. Cl. ..... 239/346; 239/322; 239/332; 239/366; 239/369; 239/424; 239/433; 222/326; 222/333; 222/389

(58) Field of Classification Search ..... 239/309, 239/322, 329, 332, 340, 346, 364, 365, 366, 239/369, 424, 433; 222/263, 326, 327, 333, 222/389

See application file for complete search history.

(56) References Cited

U.S. PATENT DOCUMENTS

| | | | | | |
|---|---|---|---|---|---|
| 2,001,207 | A | | 5/1935 | McManamna | 169/31 |
| 2,542,350 | A | | 2/1951 | Paulsen | 222/499 |
| 2,708,600 | A | | 5/1955 | Evoidevaux | 299/86 |
| 3,216,630 | A | | 11/1965 | Stull | 222/499 |
| 3,598,285 | A | | 8/1971 | Stull | 222/48 |
| 3,809,299 | A | | 5/1974 | Sand | 222/521 |
| 4,174,068 | A | | 11/1979 | Rudolph | 239/322 |
| 4,271,982 | A | | 6/1981 | Niksich | 222/83 |
| 4,358,031 | A | | 11/1982 | Lohrman | 222/153 |
| 4,432,496 | A | | 2/1984 | Ito | 239/327 |
| 4,461,408 | A | | 7/1984 | Shepard | 222/501 |
| 4,671,431 | A | | 6/1987 | Obrist | 222/327 |
| 4,712,740 | A | * | 12/1987 | Duncan et al. | 239/340 |
| 5,102,052 | A | * | 4/1992 | Demarest et al. | 239/340 |
| 5,203,507 | A | * | 4/1993 | Matthews | 239/322 |
| 5,558,277 | A | | 9/1996 | Owen et al. | 239/322 |
| 6,095,435 | A | * | 8/2000 | Greer et al. | 239/369 |
| 6,769,632 | B2 | | 8/2004 | Takeuchi | 239/412 |

* cited by examiner

*Primary Examiner*—Steven J Ganey
(74) *Attorney, Agent, or Firm*—R. Keith Harrison

(57) ABSTRACT

A substance dispersing apparatus having a cartridge used to deliver substances for the cosmetic, medical, dental, automotive, construction, and other industries.

20 Claims, 15 Drawing Sheets

APPLICATION AND METHOD TO DISPERSE SUBSTANCE CONTAINED IN A REPLACEABLE CARTRIDGE

CROSS-REFERENCE TO RELATED APPLICATIONS

This is a divisional of application Ser. No. 10/659,546, filed Sep. 9, 2003 now abandoned, which claims the benefit of U.S. Provisional application No. 60/411,485, filed Sep. 17, 2002, entitled APPLICATION AND METHOD TO DISPERSE SUBSTANCE CONTAINED IN A REPLACEABLE CARTRIDGE.

FIELD

The embodiments of the present invention relate to the field of dispersing a substance in an air or gas stream and a replaceable canister or cartridge to hold the substance.

BACKGROUND

Various devices for discharging a media, such as paint, using an air stream are known in the art. Some of these devices use refillable containers to hold the media, which is usually in liquid form. For example, paint may be sprayed using an air stream. With such application, the device and/or the container holding the media need to be cleaned after each use. If the container is not cleaned, the remaining media may contaminate the subsequent media being utilized. Typically, it is inconvenient for the user to have to clean the container after every use. In some applications, such as in the medical field, it is more advantageous to have a deposable container.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1:
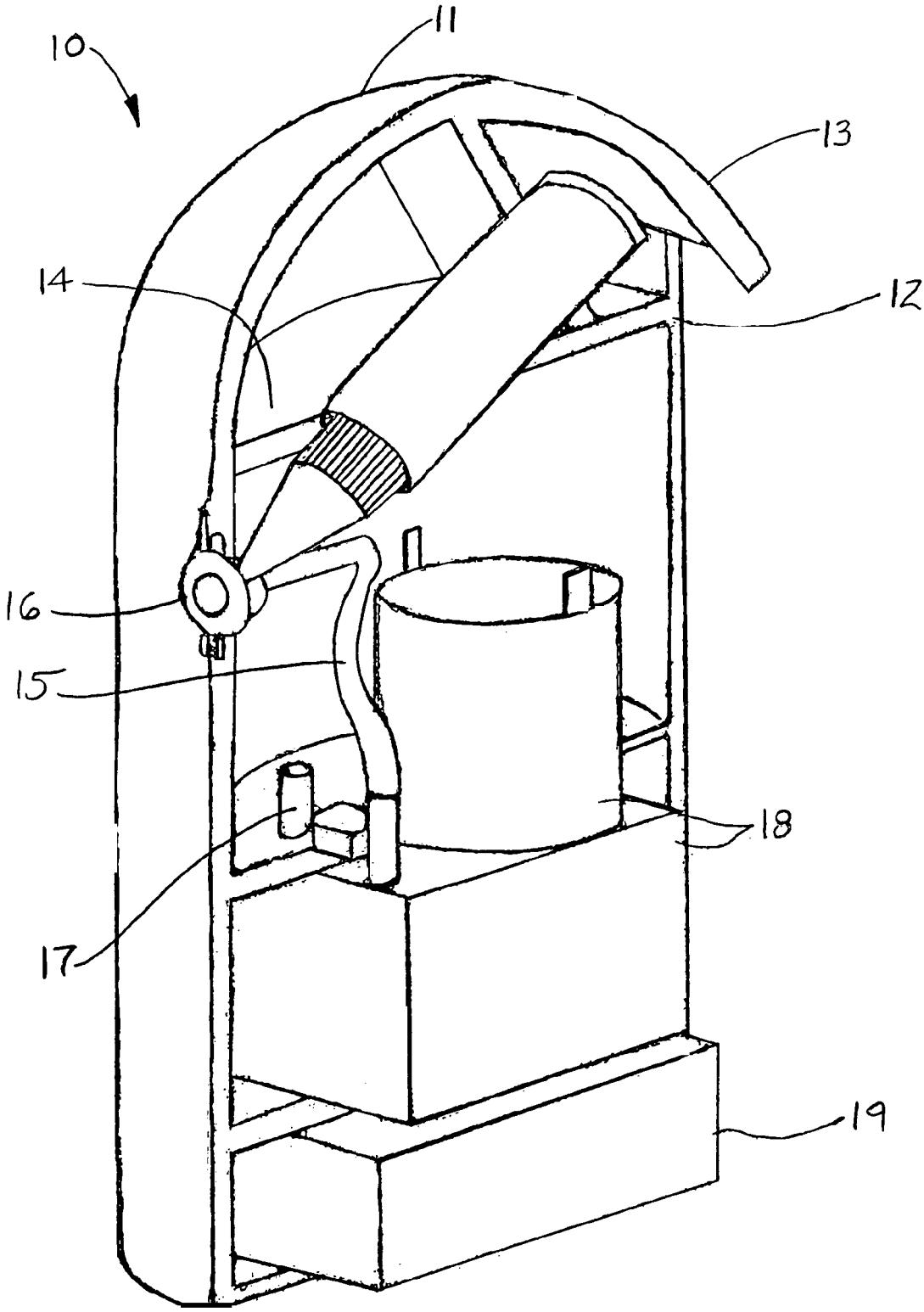
FIG. 1 shows a sectional, three-dimensional view of an applicator device, according to one embodiment of the present invention.

The various embodiments of the invention provide an applicator device to deliver a substance for the cosmetic, medical, dental, automotive, construction, and/or other industries. The embodiments of the invention also provide a replaceable canister or cartridge to contain a substance to be discharged from the applicator device.

Reference in the specification to "an embodiment", "one embodiment", "some embodiments", or "other embodiments" means that a particular feature, structure, or characteristic described in connection with the embodiments is included in at least some of the embodiments, but not necessarily all embodiments. The various appearances "an embodiment", "one embodiment", or "some" embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As illustrated in the accompanying FIGS. 1-7, FIG. 1 shows a three dimensional sectional view of an applicator device 10, according to one embodiment of the present invention. The cross-sectional view of the applicator device 10 shows a housing 11, a cartridge (or canister) 12, a door 13, one or more housing supports 14, a spray tip 16, an air pump 18, and a battery 19. The housing 11 encloses the cartridge 12, the supports 14, the spray tip 16, the air pump 18, and the battery 19. The door 13 provides an access for users to insert the cartridge 12 into the housing 11. The housing supports 14 are attached to the housing 11 and are used to position the cartridge 12 in a manner that the nozzle of the cartridge 12 is near the exit of the spray tip 16. In some embodiments, the housing supports 14 are manufactured as part of the housing 11. The battery 19 provides the electric power source to operate the air pump 18. In one embodiment of the invention, the applicator housing 11, the door 13, and the housing supports 14 are made of plastic; however, other embodiments may use other rigid materials, including metal.

Figure 3A:
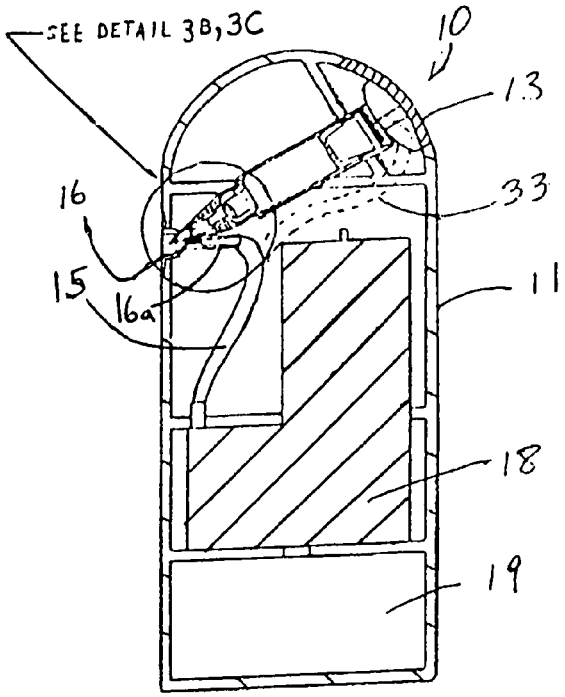
FIG. 3A shows a cross-sectional view of the applicator device of FIG. 1, and also showing a cartridge in position within a housing of the applicator device.
Figure 3C:
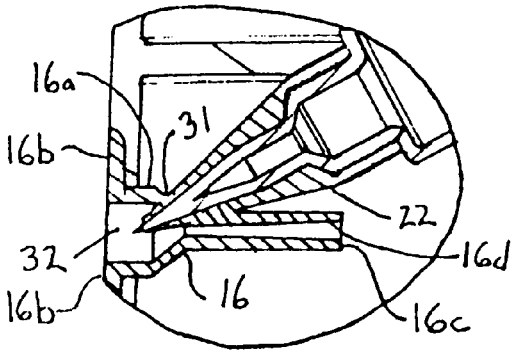
FIG. 3C shows an enlarged cross-sectional view of the cartridge nozzle molded in one piece with the spray tip.
Figure 3B:
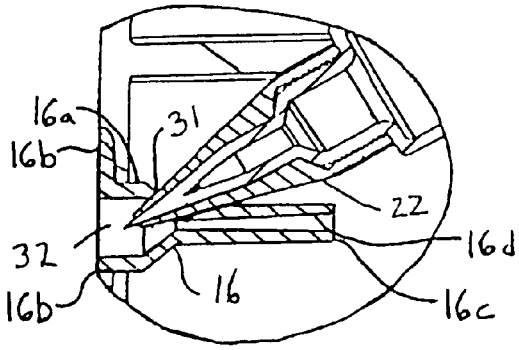
FIG. 3B shows an enlarged cross-sectional view of the cartridge nozzle of FIG. 3A when it is positioned within the spray tip of the applicator device.
Figure 4:
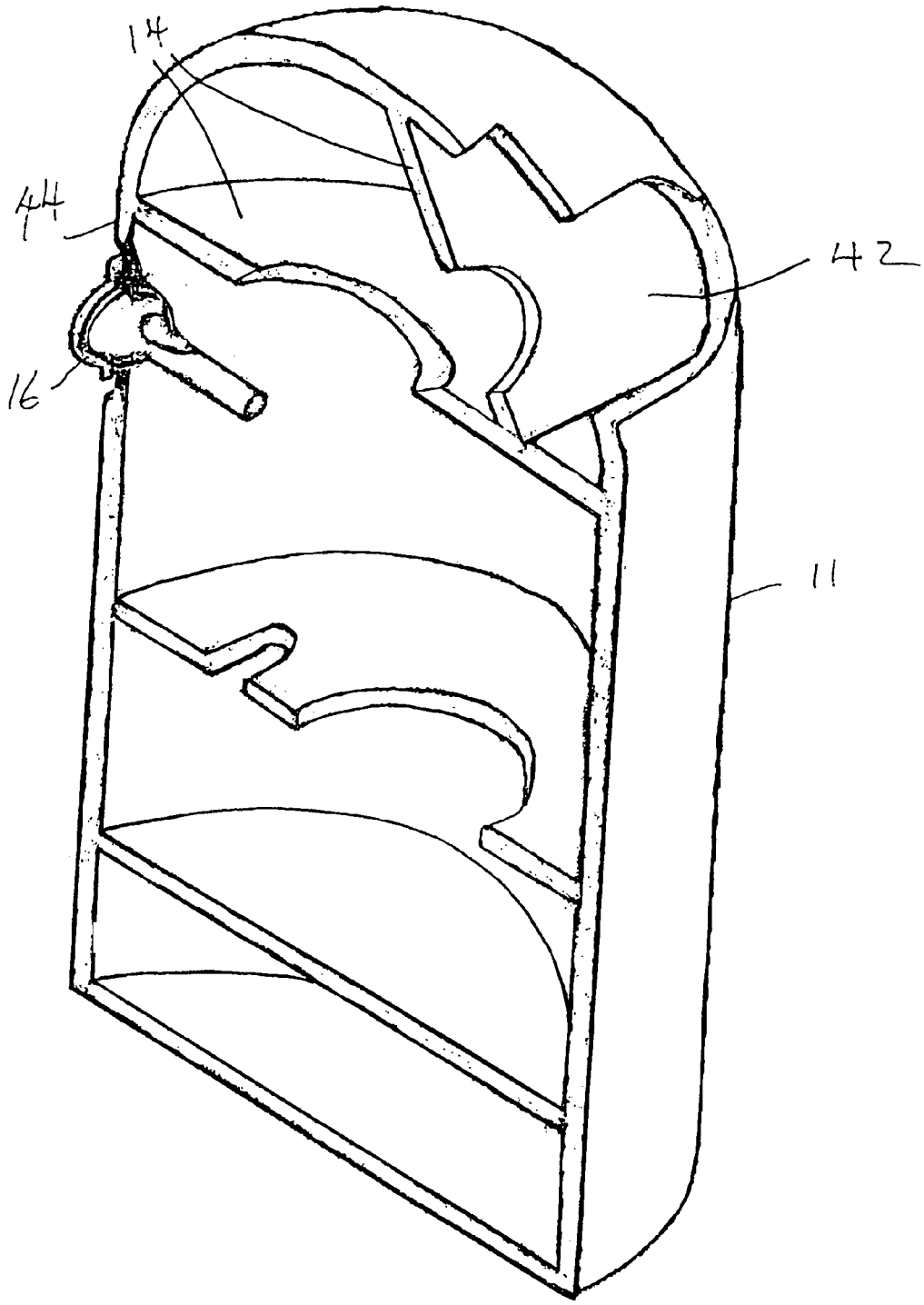
FIG. 4 shows a three-dimensional cross-sectional view of the housing of the applicator device of FIG. 1.

As shown in FIG. 3B, the spray tip 16 includes a spray tip body 16*a* having a spray tip exit 32. A flange 16*b* may be provided on the spray tip body 16*a* and engages the housing 11. A hose attachment nipple 16*c* extends from the spray tip body 16*a*. A nipple bore 16*d* extends through the hose attachment nipple 16*c* and communicates with the spray tip exit 32. The spray tip exit 32 and nipple bore 16*d* may be disposed in axially aligned relationship to each other, as shown. In FIG. 1, the air pump 18 is turned on using a switch (not shown) that may be located on the housing 11 and acquires air through the air intake 17. A hose 15 connects the air pump 18 to the hose attachment nipple 16*c*, at the end of the spray tip 16 opposite from the exit opening. The air pump 18 provides an air stream through the hose 15 to the spray tip 16. A view of the housing 11 without the air pump 18 and the battery 19 is also shown in FIG. 4.

Figure 2:
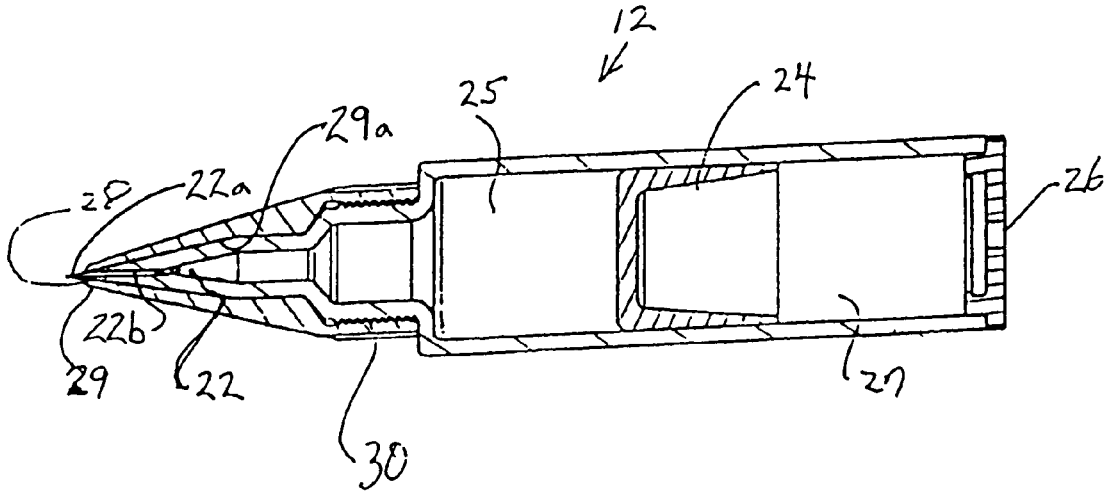
FIG. 2 shows a cross-sectional view of a cartridge used with the applicator device of FIG. 1 to dispense substances, according to one embodiment of the present invention.

FIG. 2 shows a cross-sectional view of a cartridge, such as the cartridge 12 shown in FIG. 1. The cartridge 12 is also shown in its component parts in FIG. 7. The cartridge 12, when filled with a particular substance, has the substance located within an inner chamber 25. The cartridge 12 also includes a nozzle 22 having a discharge passage 22*b*, a piston 24, and a rear opening 26. The opening 26 in the rear of the cartridge 12 allows atmospheric pressure to enter into an outer chamber 27 of the cartridge 12. As the substance is dispersed through the nozzle 22, the piston 24 may move forward to reduce the volume of the inner chamber 25. The piston 24 pushes on the substance 25 to prevent the substance 25 from shifting around within the inner chamber 25 and/or to prevent any low pressure gaps from forming within the chamber 25 as the substance is dispersed. Generally, atmospheric pressure is sufficient to allow the piston to move forward as the substance is dispersed, but in other embodiments pressurized (positive pressure) air or gas may be forced into the opening 26 to move the piston 24 forward.

Figure 7:
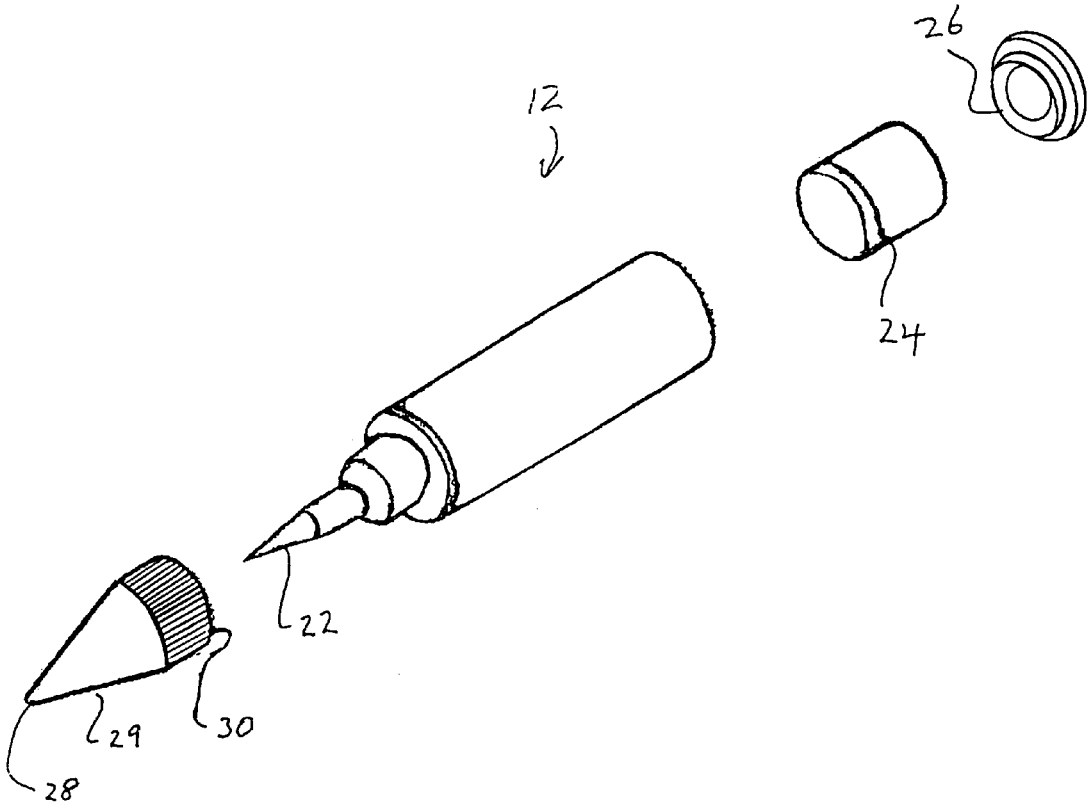
FIG. 7 is a pictorial view of the components of the replaceable cartridge shown in FIG. 1.

The nozzle 22 may be designed to have a fixed sized opening or alternatively, the nozzle 22 may be designed to be adjustable to vary the size of the orifice 28 of a nozzle tip 29. FIGS. 2 and 7 show an embodiment in which a nozzle tip 29 is fit over the nozzle 22. As shown in FIG. 2, the nozzle tip 29 has a tapered nozzle tip interior 29*a* which is complementary in shape to the nozzle 22. As further shown in FIG. 2, the nozzle 22 has a tapered nozzle apex 22*a* which defines the exit end of the discharge pathway 22*b* and extends completely through the orifice 28 of the nozzle tip 29 when the nozzle tip 29 is fully positioned on the nozzle 22 or engages the cartridge 12. The nozzle 22 may have threads 30, or other adjustable mechanism, to allow the nozzle tip 29 to move forwards and backwards over the threads 30 of the cartridge 12. In an alternative embodiment, this movement may be used to size the adjustable orifice 28 of the nozzle tip 29, since the tapered nozzle apex 22*a* extends through the orifice 28, as shown in FIG. 2, and therefore, the size of the orifice 28 varies according to the axial position of the nozzle tip 29 on the nozzle 22. That is, the size of the orifice 28 at the nozzle tip 29 may be varied when the nozzle tip 29 is turned. The size of the orifice 28 at the tip 29 is adjusted correspondingly. The nozzle 22 may be closed by covering the opening 28 with a cap (not illustrated) after the cartridge 12 has been removed from the housing 11 to prevent drying and/or clogging of the substance 25. In an alternative embodiment, the cartridge may have a one-way built in valve to allow the substance to be dispersed, but other external substances, as well as any already dispersed substance, from reentering the inner chamber 25. The discharge pathway 22*b* accommodates the flow of a fluid substance from the nozzle 22 to the tapered nozzle apex 22*a* during dispensing of the substance from the cartridge 12.

The cartridge 12 may be made tamper proof and may be discarded after use. In an alternative embodiment, the cartridge 12 may be refilled with the substance 25 or with other substances. The cartridge 12 is generally designed to have one size to fit into a particular size housing. However, the cartridge 12 may be available to have different size inner chamber, depending on the amount of substance which is to be loaded. In one embodiment of the invention, the nozzle 22 is made of plastic, bronze, brass and/or stainless steel; however, other materials may be readily used to manufacture the nozzle assembly.

Figure 6:
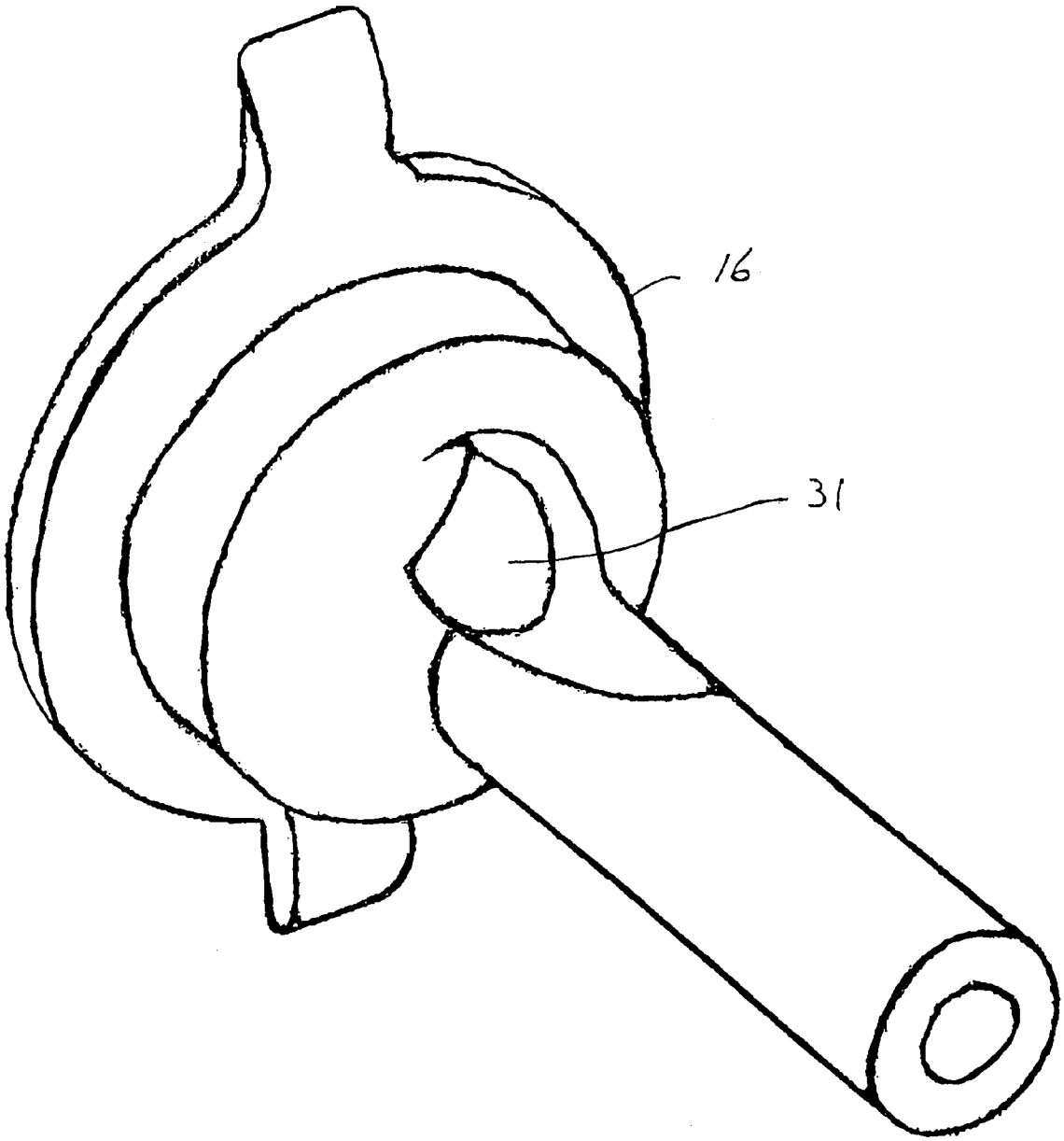
FIG. 6 is a pictorial view of the spray tip of FIG. 1.

FIG. 3A shows a cross-sectional view of the applicator device 10 of FIG. 1. Correspondingly, FIG. 6 shows an enlarged pictorial view of the spray tip 16. The hose 15 connects the air pump 18 to the end of the spray tip 16 opposite from the exit opening. The air pump 18 provides a positive pressure air stream through the hose 15 to the spray tip 16. In an alternative embodiment, hose 15 may split into two separate hoses, as shown by the hose extension 33 (dotted line). In this alternative embodiment, hose 33 attaches to the opening 26 at the rear of the cartridge 12 to supply positive air pressure to the outer chamber 27. The air pressure to one or both sections of the hose may be regulated (together or separately) to compensate for a particular value (or range of values) of air pressure.

FIG. 3B shows a more detailed view of the nozzle section of FIG. 3*a*, showing the nozzle 22 of the cartridge 12 in positioned within the spray tip 16. The spray tip 16 has an opening 31 to allow the nozzle tip 29 of the cartridge 12 to enter into the hollow passage of the spray tip 16 and to be positioned in the path of the air stream that flows through the spray tip 16 and out the spray tip exit 32. Therefore, as shown in FIGS. 3A-3C, the nozzle tip 29 of the nozzle 22 protrudes into the spray tip body 16*a*, between the spray tip exit 32 and the nipple bore 16*d* of the spray tip 16. In one embodiment, the cartridge 12 may be placed approximately at a 30-degree angle with respect to the spray tip 16. Typically, the cartridge 12 and the spray tip 16 are manufactured as separate items. However, in an alternative embodiment, the cartridge 12 and the spray tip 16 are molded together as one piece, as shown in FIG. 3C, so that the user may discard both after use. In this instance, the fitting of the nozzle tip 29 may need to be inserted from the interior of the housing, instead of from the exterior, as is shown in FIG. 3B. Different types of spray tips 16 may be available to users to result in different spray patterns.

The air stream through the spray tip 16 flows by the nozzle 22 and out the spray tip exit 32. The airflow draws out the substance 25 held within the cartridge 16 due to the Venturi effect. The atmospheric or positive pressure pushing on the piston 24 may also assist in the dispersion of the substance. Accordingly, the substance 25 is drawn out directly from within the inner chamber 25 of the cartridge 12 and out the nozzle opening 32. The substance 25 flows into the moving air stream and the substance 25 is sprayed out of the spray tip exit 32 at a uniform rate. The pattern of the dispersion may be adjusted with the selection of the nozzle and/or adjusting the size of the opening.

FIG. 4 shows a three-dimensional view of a housing opening 42 when the door 13 is open. Upper support 44 also has a cut out to allow the cartridge 12 to fit into the housing 11. A user slides the cartridge 12 through the housing opening 42, the cartridge support openings 44, and the spray tip opening 31 to position the cartridge 12 within the housing 11. The cartridge support opening 44 and the spray tip opening 31 are shaped in such a way that the cartridge 12 will pass through in the required orientation. As noted above, in one alternative embodiment the cartridge 12 and the spray tip 16 are one piece, and both the cartridge 12 and the spray tip 16 are passed through the cartridge support openings 44 to position the cartridge 12 within the housing 11.

Figure 5:
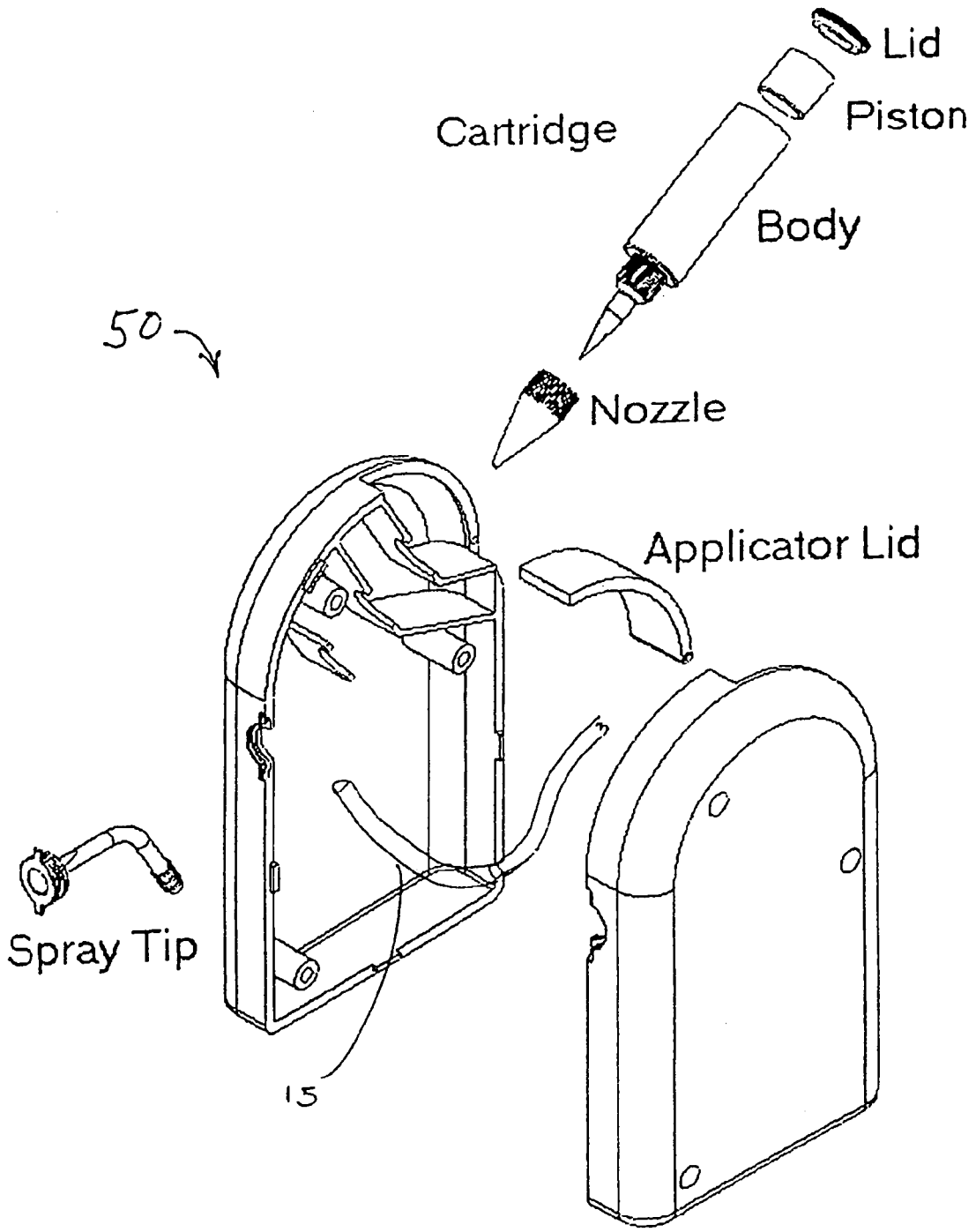
FIG. 5 shows an applicator device that uses an external source to supply the air flow to the spray tip, instead of an internal pump.

Still another embodiment is shown in FIG. 5. FIG. 5 shows an applicator device 50 that uses an external air or gas supply (not shown) to provide the airflow to the spray tip 16. In this alternative embodiment, the housing 11 includes an opening to allow the external source to be coupled to the housing 11 supply the airflow (or gas flow) through a hose to the spray tip 16. The hose is attached to the spray tip 16 to provide the airflow necessary to draw out the substance from the nozzle tip 29. In this embodiment, an internal battery 19 and air pump 18 would not be needed because an external source provides the airflow. In this embodiment, the user would connect the external source to the applicator device 50 and start the airflow. The air stream would flow into the applicator 50 and to the spray tip 16, and the substance would be discharged in a uniform pattern in the same manner as described above. In other embodiments, an extension hose may be attached to the dispersion opening to extend the reach of the substance. The extension hose may be used with the earlier described pump versions as well.

Figure 8A:
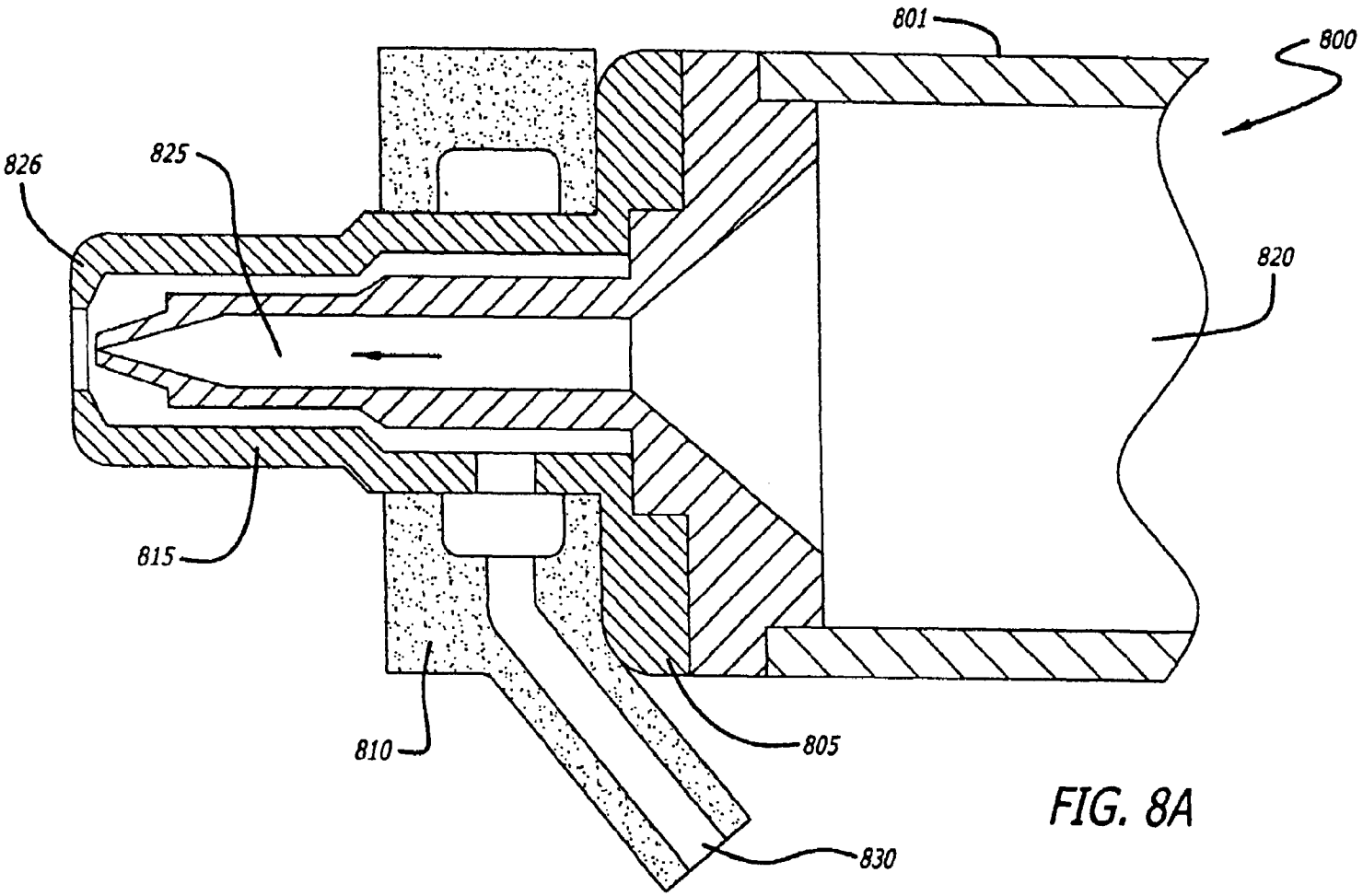
FIGS. 8A-8B illustrate an embodiment of an applicator device and cartridge for discharging water consistency media.
Figure 8B:
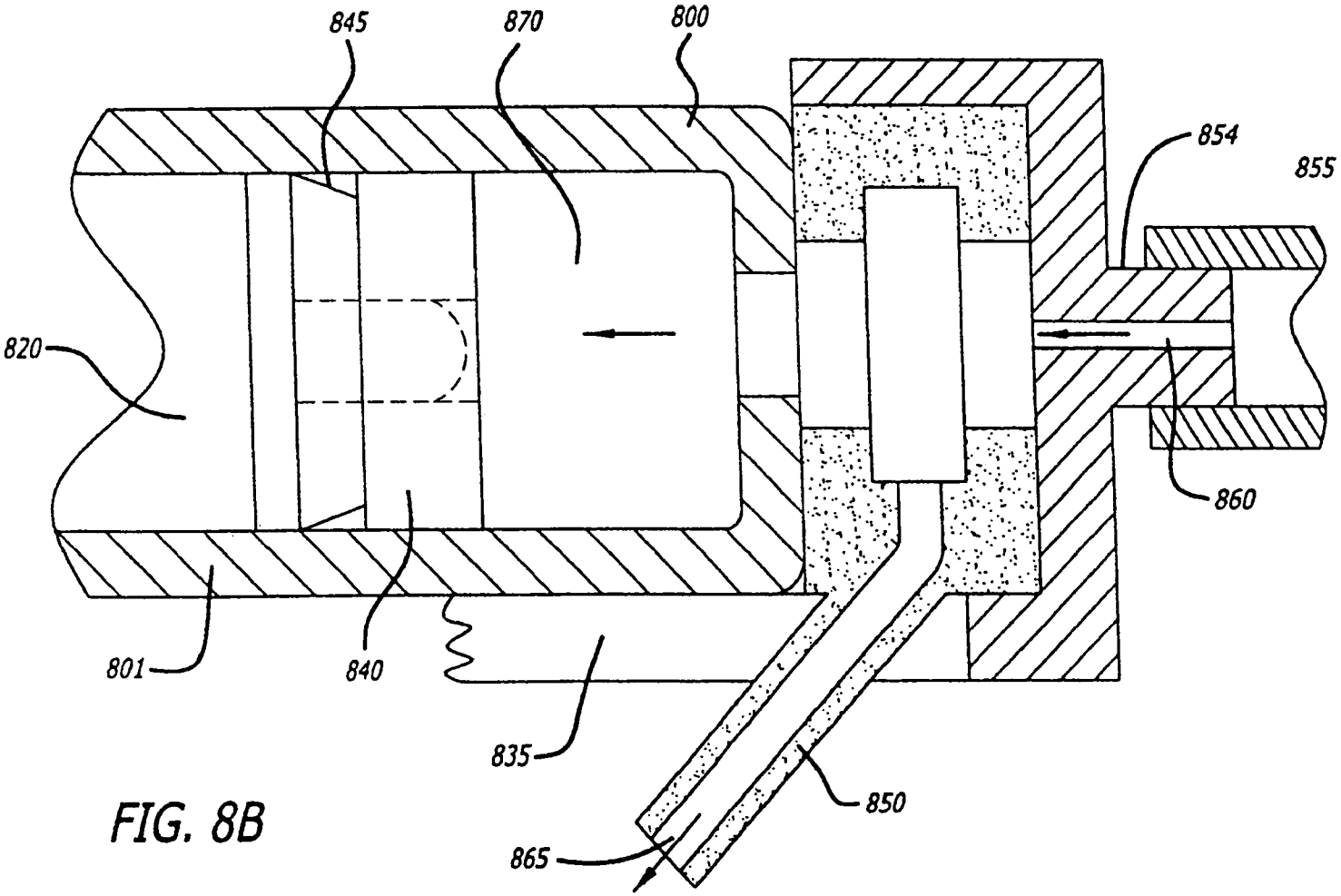
Figure 9:
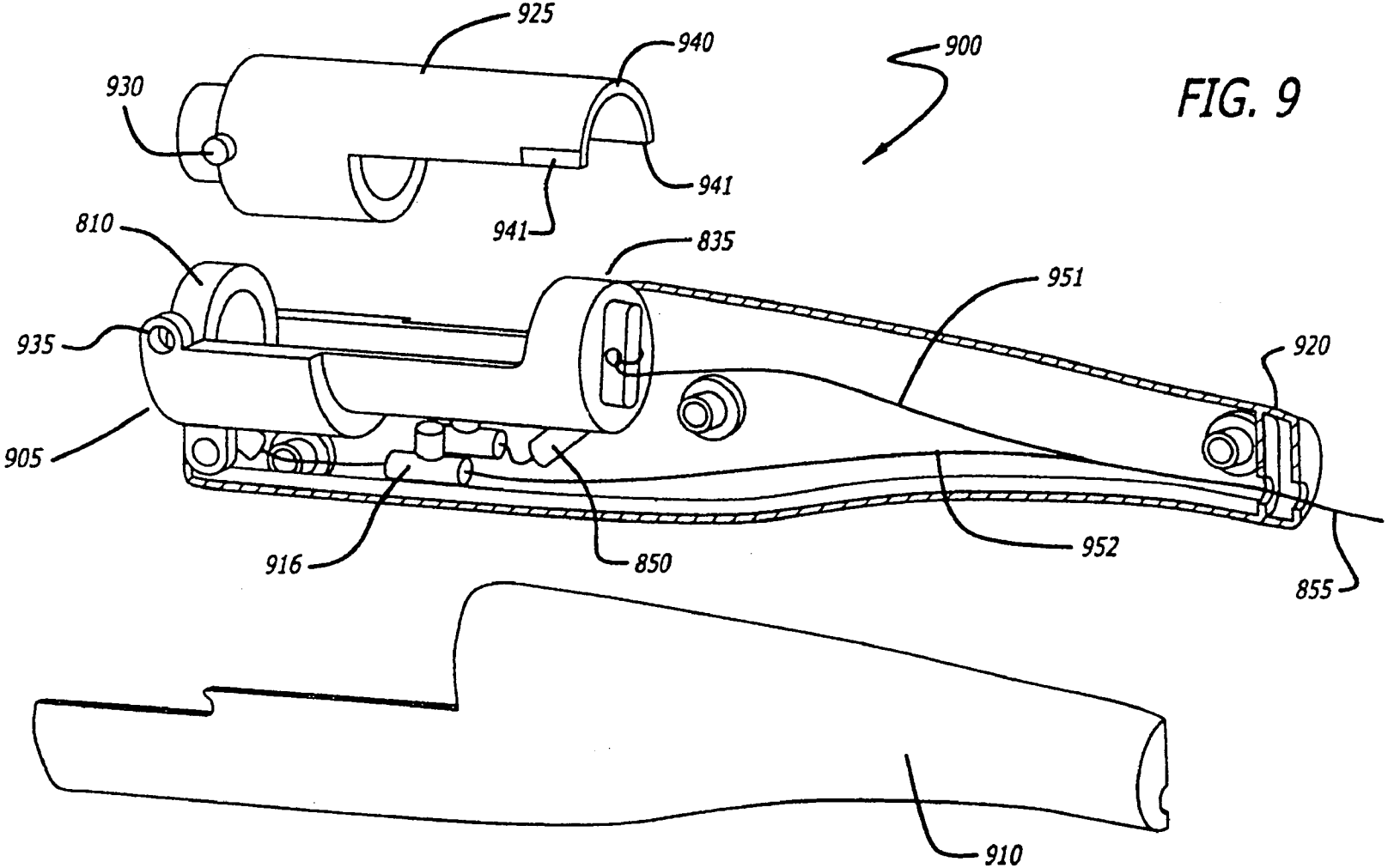
FIG. 9 illustrates an embodiment for an applicator device.

FIGS. 8A and 8B illustrate an embodiment of an applicator device and cartridge for discharging water consistency media shown inserted in an applicator device (also see FIG. 9). Applicator device 800 is illustrated with cartridge body 801 inserted. Also illustrated in FIGS. 8A-B are cartridge cap 805, front air seal 810, orifice cap 815, air inlet (for spraying) 830, lower cartridge carrier 835, air outlet vent 865, rear air seal 850, air line attachment portion 854, and rubber seal 845. In one embodiment air line attachment portion 854.is coupled to an air hose supplying compressed air, such as an air compressor. In another embodiment, air line attachment portion 854 is coupled to a portable air system supply having a motor and pump. Fluid media is contained within cartridge body 801. When rear air seal 850 is closed, forced air incoming from applicator air line 855 is forced against piston 840. The fluid media is forced in the direction indicated by reference numeral 825. Air enters air inlet 830 and a stream or air brush type of spray exits tip opening 826.

FIG. 9 illustrates an embodiment for an applicator device for inserting cartridge 801 into. Applicator device 900 includes left-side 910, right side 920, rear air valve 915, front air valve 916, lower cartridge carrier 905, and upper cartridge carrier 925. In one embodiment, upper cartridge carrier 925 is coupled to lower cartridge carrier 905 by front coupling portions 930 inserted into openings 935 on lower cartridge carrier 905. At upper cartridge carrier end portion 940, end fitting portions 941 fit into lower cartridge carrier 905.

A cartridge is inserted into applicator device 900 as follows. With upper cartridge carrier 925 in an open state (i.e. upper cartridge carrier 925 is moved perpendicularly from lower cartridge carrier 905. Cartridge 801 is loaded with exit opening 826 (located at the nose portion) first into the front air seal 810. The upper cartridge carrier 925 is then closed by moving the upper cartridge carrier 925 so that upper cartridge carrier end portion is engaged with lower cartridge carrier 905. In this way, cartridge 801 has a rear portion seated against rear air seal 850.

To place applicator 900 and cartridge 801 to use, an air line (e.g., an air hose coupled to a compressor) is coupled to applicator air line 855. As illustrated, applicator air line 855 is split with an upper line 951 coupled to air line attachment portion 854 located at the rear of lower cartridge carrier 835 (i.e., air flows through rear air seal 850 to pressurize the rear of cartridge 801 unless rear air valve 915 is opened) and lower portion 952 coupled to air inlet 830 (air flows through front air seal 935 through a hole in orifice cap 815, between front air valve 916 and cartridge cap 805 and out tip opening 826 unless vented). As upper cartridge carrier 925 is pressed down towards lower cartridge carrier 905 front air valve 916 is closed, thus causing air to blow out tip opening 826. Pressing down further on upper cartridge carrier 925 closes rear air valve 915. As rear air valve 915 is closed, cartridge 801 is pressurized advancing piston 840, which causes fluid media 820 to flow into the air stream created. Thus, a media spray exits tip opening 826. Applicator 900 is sized to fit in a person's hand for easy use.

Figure 10A:
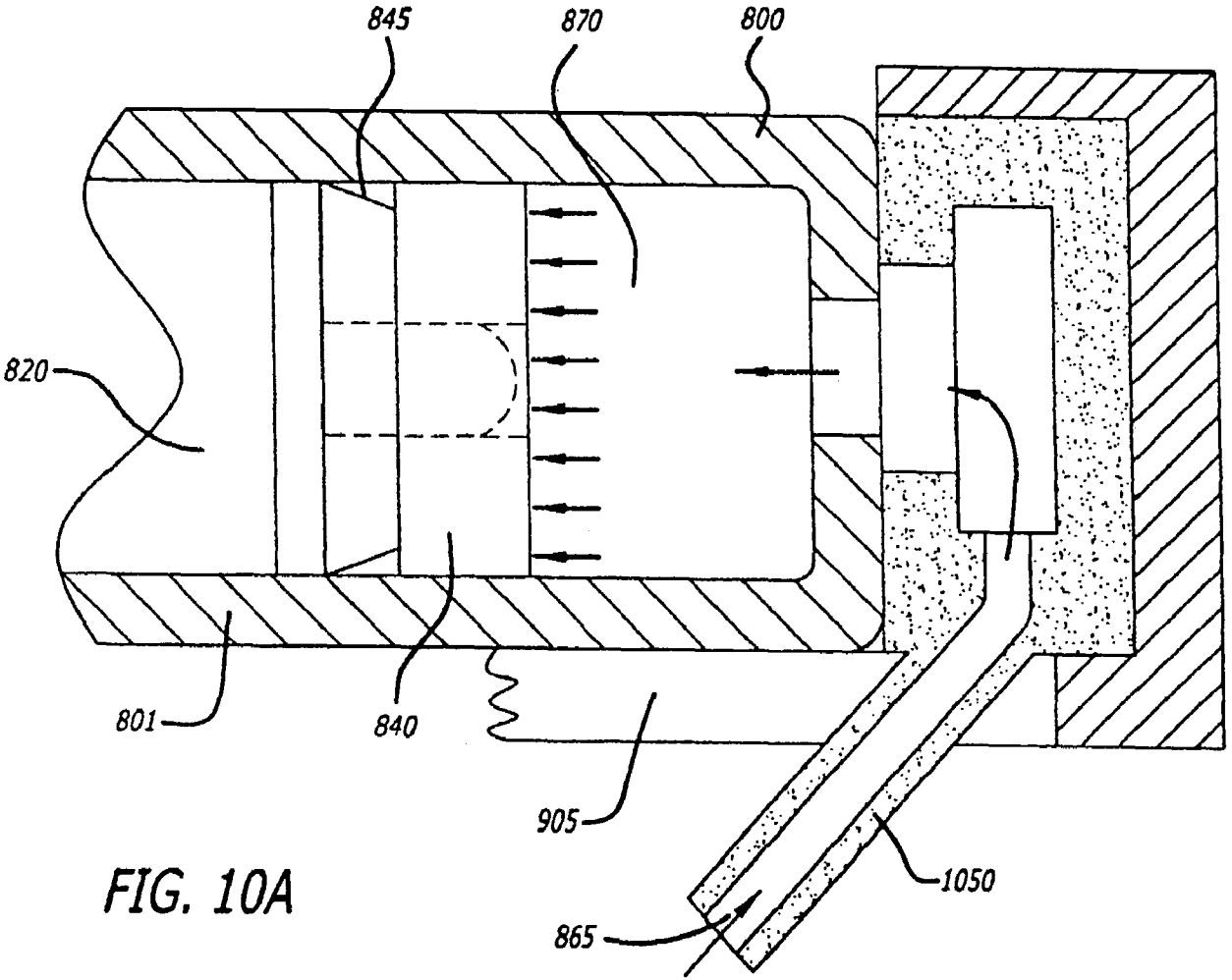
FIG. 10A-B illustrate an embodiment of an applicator device and cartridge for dispersing fine sprays, mist, or atomized spray.
Figure 10B:
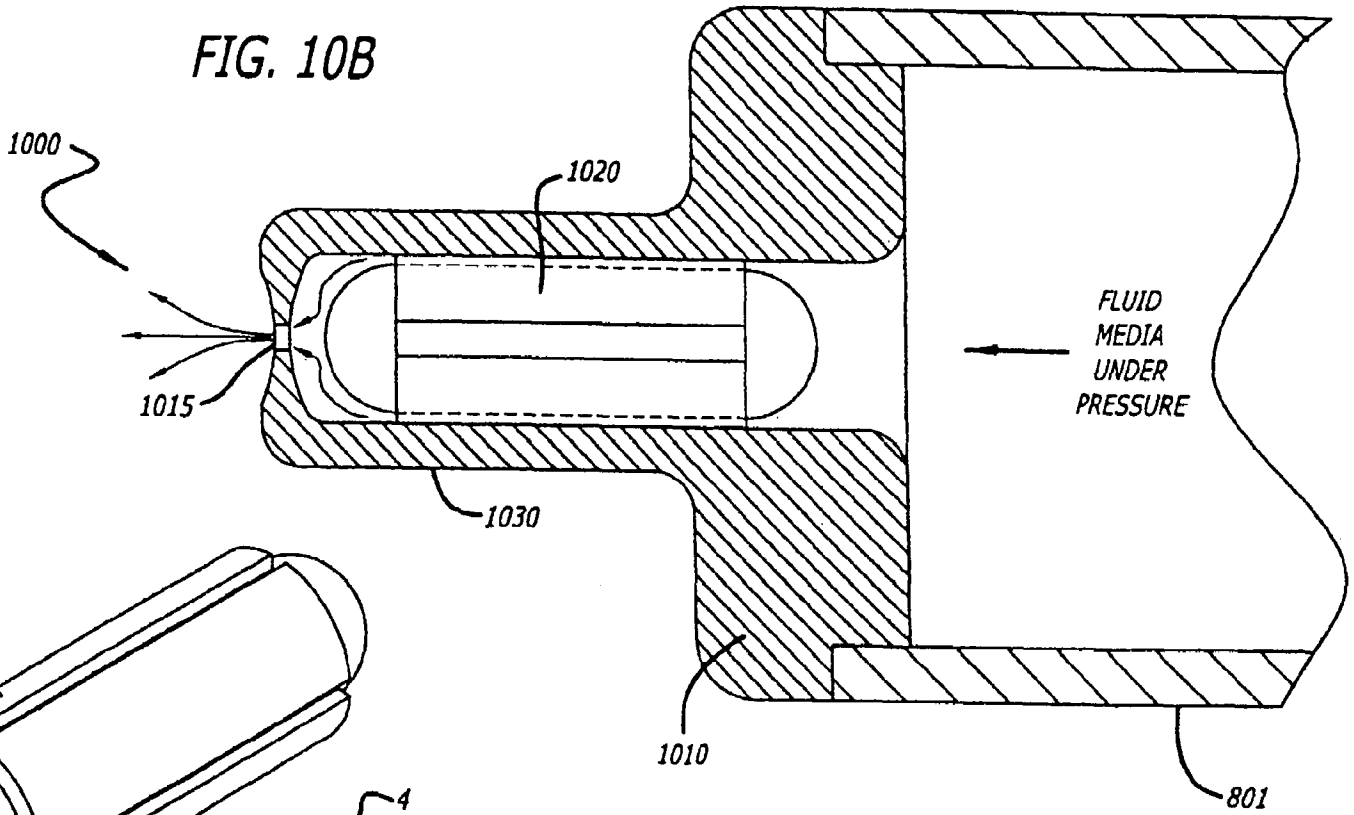
Figure 10C:
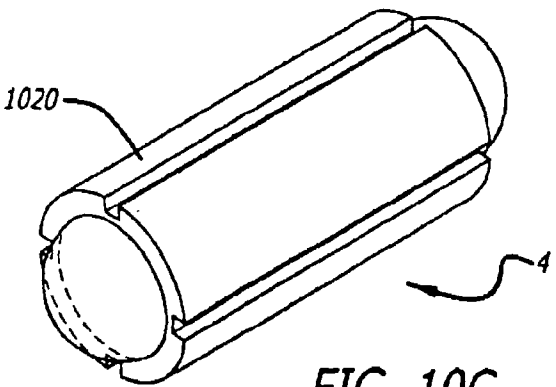
FIG. 10C illustrates a spreader plug removed from the applicator device illustrated in FIGS. 10A-B.

FIGS. 10A-C illustrate an embodiment of an applicator device and cartridge for dispersing fine sprays, mist, or atomized spray for discharging water consistency media. As illustrated in FIG. 10B, applicator device 1000 includes atomizer cap 1010, removably coupled spreader plug 1020, spray tip 1015 and nose portion 1030. FIG. 10A, while similar to FIG. 9B, differs by reconfigured rear air seal 1050. Rear air seal 1050 is revised from rear seal 850 so that high pressure/low volume air flows into the rear of cartridge 800 to advance piston 840 to force fluid media 820 to be atomized through spray tip 1015.

FIG. 10C illustrates spreader plug 1026 removed from applicator device 1000. In one embodiment, spreader plug 1026 has four grooves the length of the plug. In other embodiments, spreader plug can have a greater or fewer number of grooves, such as 3, 5, etc.

Applicator device 1000 forces fluid media 820 at high pressure and velocity through the plurality of grooves in spreader plug 1026 up to the inside spray tip 1015 radius through small diameter short land length orifice formed between spreader plug 1026 and an internal nose portion out through spray tip 1015, which has a reverse radius opening. In this embodiment, air line 855 is not split, but instead is coupled through front air valve 916 and is piped back to rear air seal 1050. Applicator 1000 is sized to fit in a person's hand for easy use.

Figure 11:
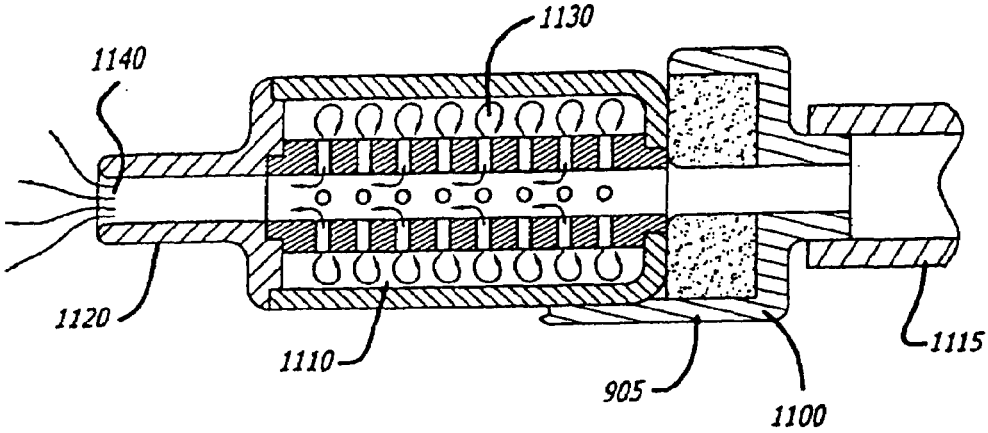
FIG. 11 illustrates an embodiment including an applicator device and a cartridge for spraying or dusting fine dry powder media.

FIG. 11 illustrates an embodiment including applicator device 1100 and a cartridge for spraying or dusting fine dry powder media. In this embodiment, cartridge 1110 includes a plurality of openings within the cartridge where air flows through the center of the tubular shaped cartridge. Dry powdered media 1130 is drawn through the center of cartridge 1110 through a Venturi effect, which draws the powdered media 1130 into the formed air stream. In this embodiment, the air flow is not high pressured. As the air flows through applicator device 1100 and cartridge 1110, a fine powder dust or spray exits spray tip 1140 through nose portion 1120. Applicator 1100 is sized to fit in a person's hand for easy use.

Figure 12:
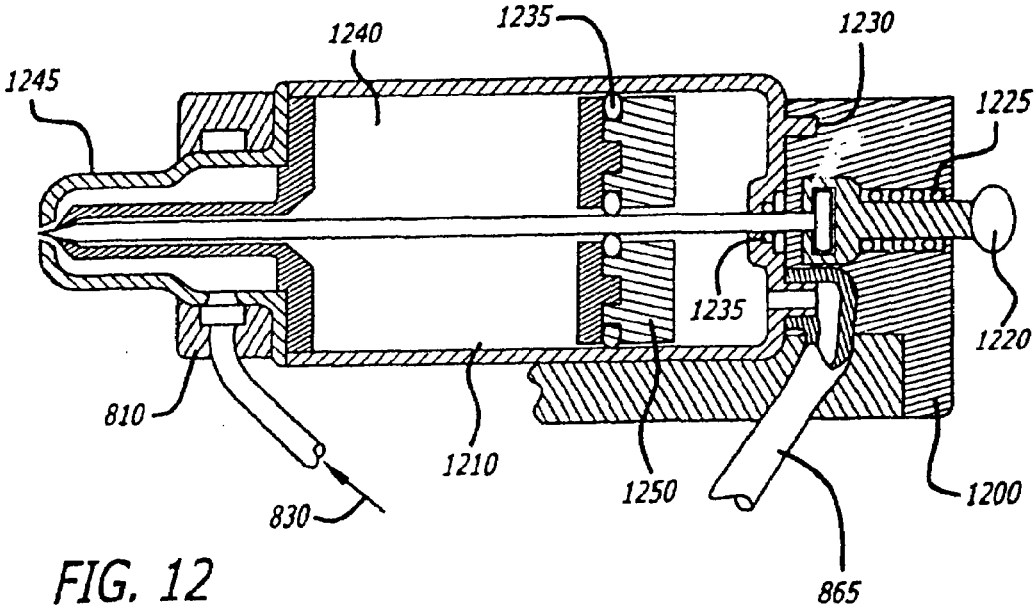
FIG. 12 illustrates an embodiment including an applicator device and cartridge with the addition of a needle valve trigger.

FIG. 12 illustrates an embodiment including an applicator device and cartridge with the addition of a needle valve trigger. Applicator device 1200 includes media cartridge 1240, o-ring seals 1235, cartridge alignment tab 1230, media trigger 1220 (including return spring 1225), spray tip 1245 and similar elements to the applicator device and cartridge illustrated in FIGS. 8A-B and 9. In this embodiment, media trigger 1220 controls the flow of media through spray tip 1245. As a user withdraws trigger 1220, media flow is controlled by controlling the size of the opening of spray tip 1245. Return spring 1225 is coupled with a portion of the trigger assembly and the rear of applicator device 1200. After trigger 1220 is pulled, the return spring acts to return the trigger assembly to its original location (i.e., closing the spray tip opening). O-ring seals 1235 are coupled to the trigger assembly so that the rod portion of the trigger assembly slides through the o-ring seals 1235 and piston 1250. Air is forced against piston 1250 (piston 1250 having a thru-hole) and media 1240 is forced to flow towards spray tip 1245 when trigger 1220 is withdrawn. Applicator 1200 is sized to fit in a person's hand for easy use.

Figure 13C:
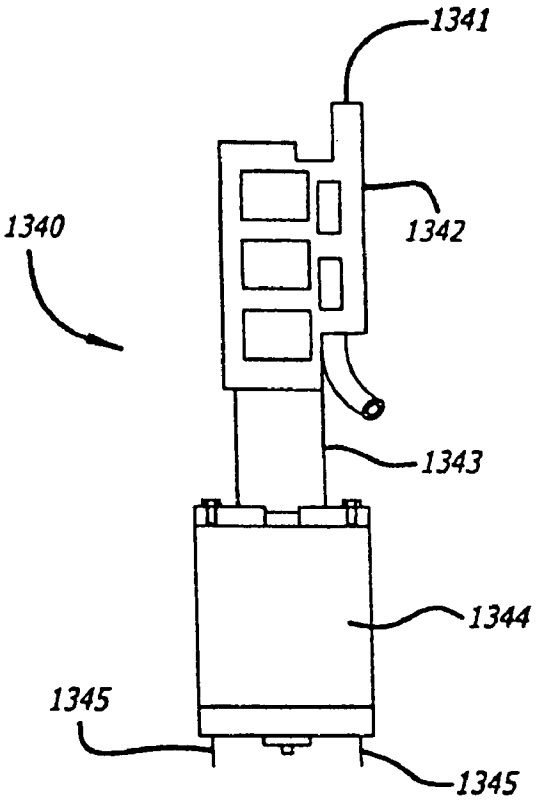
FIG. 13C illustrates an embodiment including a portable pump and motor assembly for a high-pressure/low volume or atomized spray.
Figure 13B:
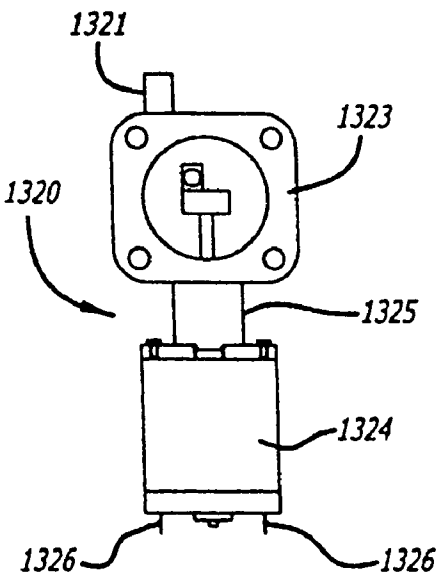
FIG. 13B illustrates an embodiment including a portable pump and motor assembly for a medium-pressure.
Figure 13A:
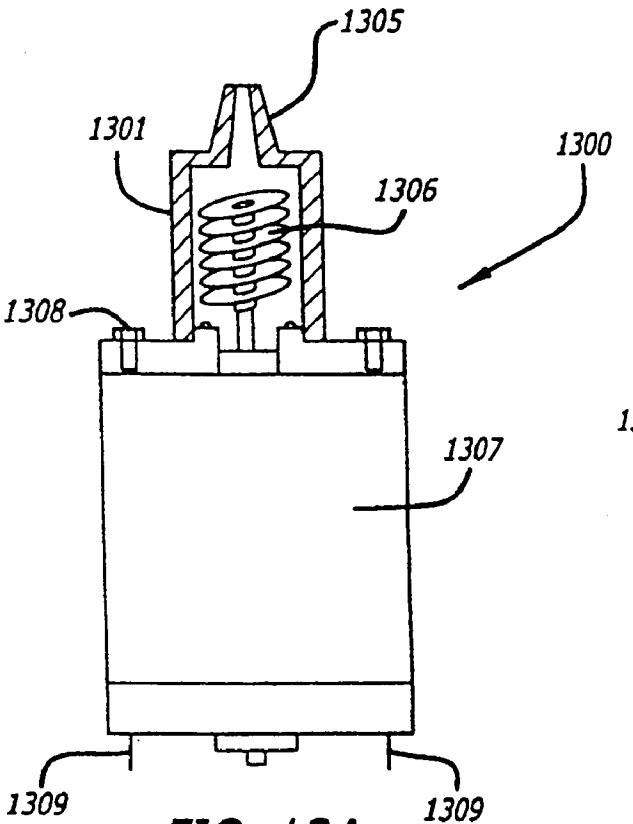
FIG. 13A illustrates an embodiment including a portable pump and motor assembly for a low-pressure (soft air blower).

FIGS. 13A-C illustrate three different embodiments for coupling portable air systems to the above-mentioned applicator device embodiments. FIG. 13A illustrates an embodiment including a portable pump and motor assembly for a low-pressure (soft air blower). In this embodiment, portable air system 1300 includes motor 1307 and blower assembly 1301. Motor 1307 can be motors known in the field, such as tin can motors, DC motors with gear reduction, etc. Motor 1307 can be any DC motor suitable for the application. Therefore, motor 1307 can be a motor with various power ratings, revolutions per minute (RPM), etc. Motor 1307 includes power source leads 1309. In one embodiment power source leads 1309 are coupled to batteries (not shown), such as AA batteries, AAA batteries, etc. In another embodiment, an AC/DC adaptor can be used to supply power to motor 1307.

In one embodiment, blower assembly 1307 includes air-in vent 1308, fan blade 1306, air-out vent 1305. In one embodiment, fan blade 1306 is helical shaped. Fan blade 1306 is coupled to a motor shaft (not shown) on motor 1307. As power is supplied to motor 1307, the motor shaft turns, which spins fan blade 1306. As fan blade 1306 spins, air is drawn in through air-in vent 1308 and air is forced out through air-out vent 1305.

FIG. 13B illustrates an embodiment including a portable pump and motor assembly for a medium pressure (e.g., for medium such as makeup, air-brush paint, etc.). In this embodiment, portable air system 1320 includes motor 1324 and pump assembly 1323. Motor 1324 can be motors known in the field, such as tin can motors, DC motors with gear reduction, etc. Motor 1324 can be any DC motor suitable for the application. Therefore, motor 1324 can be a motor with various power ratings, revolutions per minute (RPM), etc. In one embodiment motor 1324 includes power source leads 1326 and a gear reduction device 1325. In one embodiment power source leads 1326 are coupled to batteries (not shown), such as AA batteries, AAA batteries, etc. In another embodiment, an AC/DC adaptor can be used to supply power to motor 1324.

In one embodiment, pump assembly 1323 is a diaphragm pump with air-out vent 1321. As power is supplied to motor 1324, the motor shaft turns, which operates pump assembly 1323. As pump assembly 1323 is operated, air is forced out through air-out vent 1321.

FIG. 13C illustrates an embodiment including a portable pump and motor assembly for a high-pressure/low volume or atomized spray. In this embodiment, portable air system 1340 includes motor 1344 and pump assembly 1342. Motor 1344 can be motors known in the field, such as tin can motors, DC motors with gear reduction, etc. Motor 1344 can be any DC motor suitable for the application. Therefore, motor 1344 can be a motor with various power ratings, revolutions per minute (RPM), etc. In one embodiment motor 1344 includes power source leads 1345 and a gear reduction device 1343. In one embodiment power source leads 1345 are coupled to batteries (not shown), such as AA batteries, AAA batteries, etc. In another embodiment, an AC/DC adaptor can be used to supply power to motor 1344.

In one embodiment, pump assembly 1342 is a triplex pump including a small piston with a short stroke (not shown) and air-out vent 1341. As power is supplied to motor 1344, the motor shaft turns, which operates pump assembly 1342. As pump assembly 1342 is operated, air is forced out through air-out vent 1341.

Figure 14:
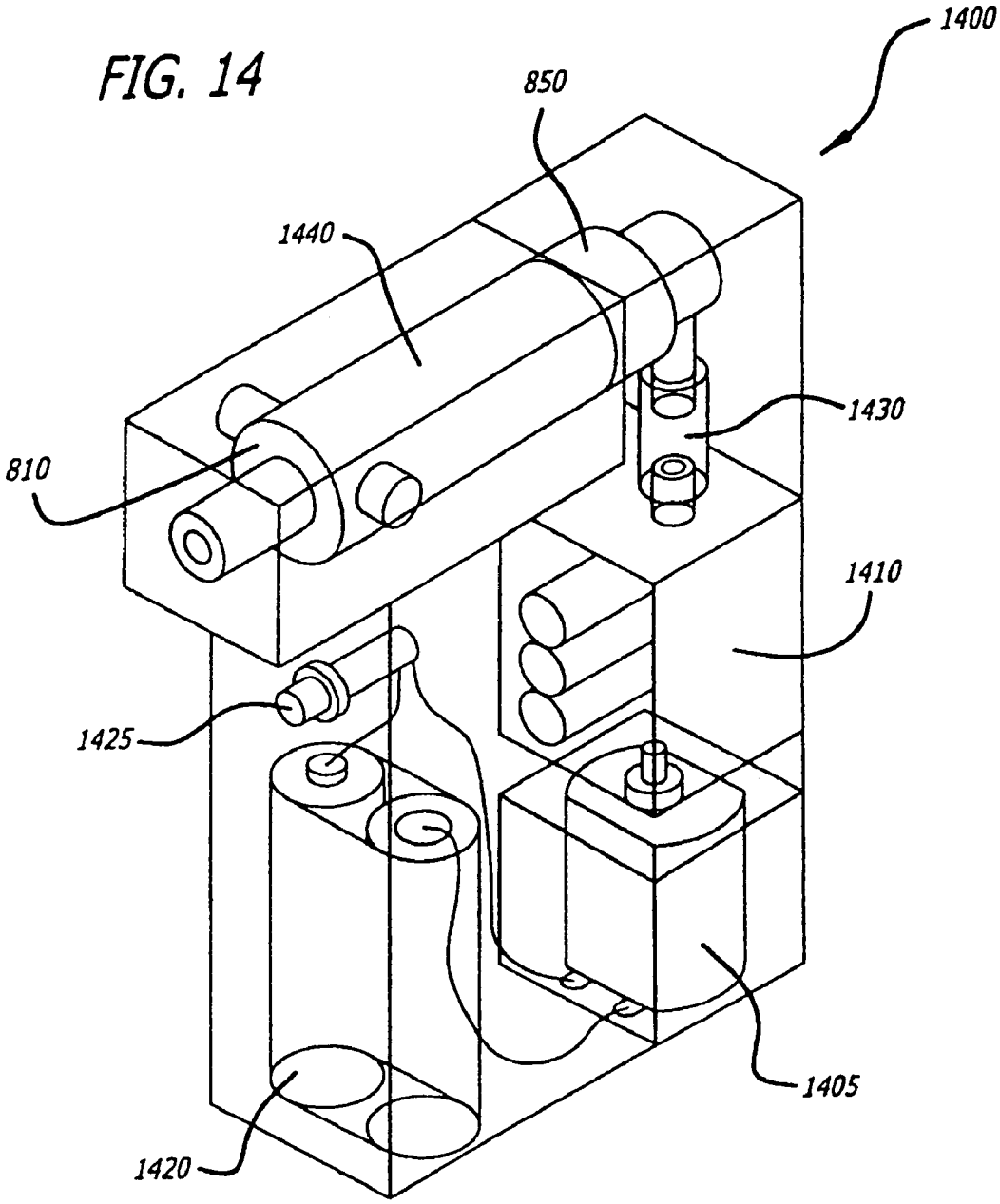
FIG. 14 illustrates a portable applicator device and cartridge system.

FIG. 14 illustrates a portable applicator device and cartridge system. System 1400 includes applicator device 1440 (including a cartridge), trigger 1425, power source 1420, motor 1405, pump 1410 and pump-applicator coupler 1430. Motor 1405 can be any of the above-described motors, such as 1309, 1326, 1345, etc. Pump 1410 can be any of the above-described pumps, such as 1301, 1323, 1342, etc. Power source 1420 can be a plurality of batteries (either rechargeable or not), such as AA, AAA, etc. In one embodiment, power source includes at least two AA batteries. It should be noted that an AC/DC converter can also be used with system 1400. Applicator device 1440 can be any of the above-described applicator devices, such as 800, 900, 1000, 1100, 1200, etc. Therefore, system 1400 can be designed with variations of motors, pumps, applicator devices and cartridges for various requirements, such as low-pressure, medium-pressure and high-pressure/low volume. Applicator device 1440 can have various cartridges inserted to meet various medium requirements. System 1400 is sized to fit in a person's hand for easy use.

Accordingly, a variety of applicator devices may be designed as different embodiments to practice the invention. The applicator may be used in various fields. For example, without limitation, these areas of application are:

1. Application of makeup and other cosmetic substances;
2. Application of drugs and medication for medical and dental use;
3. Application of medication for treating burns;
4. Application of medication or other substances internally to a body by having an extension hose coupled to the dispersion opening;
5. Application of paint;
6. Application of chemicals;
7. Application of household chemicals and cleaning liquids;
8. Application of various other liquids or even suspended solids;
9. Application of liquid spray for construction and automotive industries; and
10. Variety of other uses in other industries.

While the preferred embodiments of the invention have been described above, it will be recognized and understood that various modifications can be made in the invention and the appended claims are intended to cover all such modifications which may fall within the spirit and scope of the invention.

The invention claimed is:

1. An apparatus comprising:

a housing;

a cartridge disposed in said housing;

a spray tip disposed in said housing in fluid communication with said cartridge, said spray tip including a spray tip body disposed in fluid communication with said cartridge, a spray tip exit provided in said spray tip body and a hose attachment nipple having a nipple bore extending from said spray tip body;

an air pump provided in said housing and disposed in pneumatic communication with said hose attachment nipple of said spray tip; and wherein a medium in said cartridge is dispensed through said spray tip when said cartridge is pressurized.

2. The apparatus of claim 1 wherein said air pump is disposed in pneumatic communication with said cartridge.

3. The apparatus of claim 1 further comprising at least one battery connected to said air pump.

4. The apparatus of claim 1 wherein the cartridge and the spray tip are molded together as one unit.

5. The apparatus of claim 1 wherein the cartridge is a replaceable cartridge.

6. The apparatus of claim 1 further comprising at least one housing support provided in said housing and wherein said cartridge is supported by said at least one housing support.

7. The apparatus of claim 1 wherein said cartridge is disposed at about a 30-degree angle with respect to said spray tip.

8. The apparatus of claim 1 further comprising a door provided in said housing adjacent to said cartridge.

9. An apparatus comprising:

a housing;

a cartridge disposed in said housing, said cartridge including an inner chamber and a nozzle having a tapered nozzle tip communicating with said inner chamber;

a spray tip disposed in said housing, said spray tip including a spray tip body disposed in fluid communication with said nozzle tip of said nozzle, a spray tip exit provided in said spray tip body and a hose attachment nipple having a nipple bore extending from said spray tip body;

an air pump provided in said housing and disposed in pneumatic communication with said hose attachment nipple of said spray tip; and wherein a medium in said cartridge is dispensed through said spray tip when said cartridge is pressurized.

10. The apparatus of claim 9 wherein said hose attachment nipple is disposed at a generally acute angle with respect to said nozzle of said cartridge.

11. The apparatus of claim 10 wherein said generally acute angle is about 30 degrees.

12. The apparatus of claim 9 wherein said air pump is disposed in pneumatic communication with said cartridge.

13. The apparatus of claim 9 further comprising a battery connected to said air pump.

14. The apparatus of claim 9 further comprising a flange extending from said spray tip body of said spray tip and engaging said housing.

15. The apparatus of claim 9 further comprising at least one housing support provided in said housing and wherein said cartridge is supported by said at least one housing support.

16. The apparatus of claim 9 further comprising a door provided in said housing adjacent to said cartridge.

17. An apparatus comprising;

a housing;

a cartridge disposed in said housing, said cartridge including an inner chamber, a nozzle having a nozzle tip communicating with said inner chamber and a piston disposed in said inner chamber;

a spray tip disposed in said housing in fluid communication with said cartridge, said spray tip having a spray tip exit provided in fluid communication with said nozzle tip and a hose attachment nipple having a nipple bore disposed in linearly aligned relationship to said spray tip exit, said nozzle tip terminating between said spray tip exit and said nipple bore of said hose attachment nipple and disposed at an acute angle with respect to said nipple bore;

an air pump provided in said housing;

a hose disposed in pneumatic communication with said air pump and said hose attachment nipple of said spray tip;

a hose extension disposed in pneumatic communication with said hose and said inner chamber of said cartridge; and wherein a medium in said inner chamber of said cartridge is dispensed through said spray tip when said cartridge is pressurized.

18. The apparatus of claim 17 further comprising a door provided on said housing adjacent to said cartridge.

19. The apparatus of claim 17 further comprising a flange extending from said spray tip body of said spray tip and engaging said housing.

20. The apparatus of claim 17 further comprising at least one housing support provided in said housing and wherein said cartridge is supported by said at least one housing support.

* * * * *